United States Patent [19]

Rimmele

[11] 4,138,334

[45] Feb. 6, 1979

[54] TRASH COLLECTOR

[75] Inventor: Karl Rimmele, Schmerikon, Switzerland

[73] Assignee: Mecafina S.A., St. Gallen, Switzerland

[21] Appl. No.: 748,456

[22] Filed: Dec. 8, 1976

[30] Foreign Application Priority Data

Dec. 11, 1975 [CH] Switzerland ..... 16113/75

[51] Int. Cl.[2] ..... B01D 35/16

[52] U.S. Cl. ..... 210/159

[58] Field of Search ..... 210/159, 160, 161, 162

[56] References Cited

U.S. PATENT DOCUMENTS

| | | | |
|---|---|---|---|
| 1,984,891 | 12/1934 | Mick et al. | 210/159 |
| 2,186,790 | 1/1940 | Smyser | 210/162 |
| 2,524,304 | 10/1950 | Breda | 210/162 |
| 3,193,104 | 7/1965 | Leach | 210/159 |
| 3,358,837 | 12/1967 | Tillett et al. | 210/159 |
| 3,482,698 | 12/1969 | Ostmas | 210/159 |
| 3,591,006 | 7/1971 | Dafemer | 210/159 |

*Primary Examiner*—Theodore A. Granger

[57] ABSTRACT

The invention relates to a trashrack installation for liquid borne trash, the installation having trash collecting rack rods and a rack cleaner mechanism for cleaning the rack rods and which includes a toothed comb mounted on a tilting mechanism and pivotable between a cleaning position and a free position. The tilting mechanism is mounted pivotably on a carrier which can be moved by means of a conveyor mechanism along a guiding device, tilting of the tilting mechanism relative to the carrier being actuated by movement of the conveyor mechanism and the guiding device being arranged remote from the rack rods through which the liquid flows. The carrier includes a brake mechanism, the braking force of which is sufficient to prevent movement of the carrier under gravity, but which is insufficient to prevent the conveyor mechanism moving the carrier either in a direction for cleaning or in a return direction.

17 Claims, 2 Drawing Figures

TRASH COLLECTOR

Figure 1:
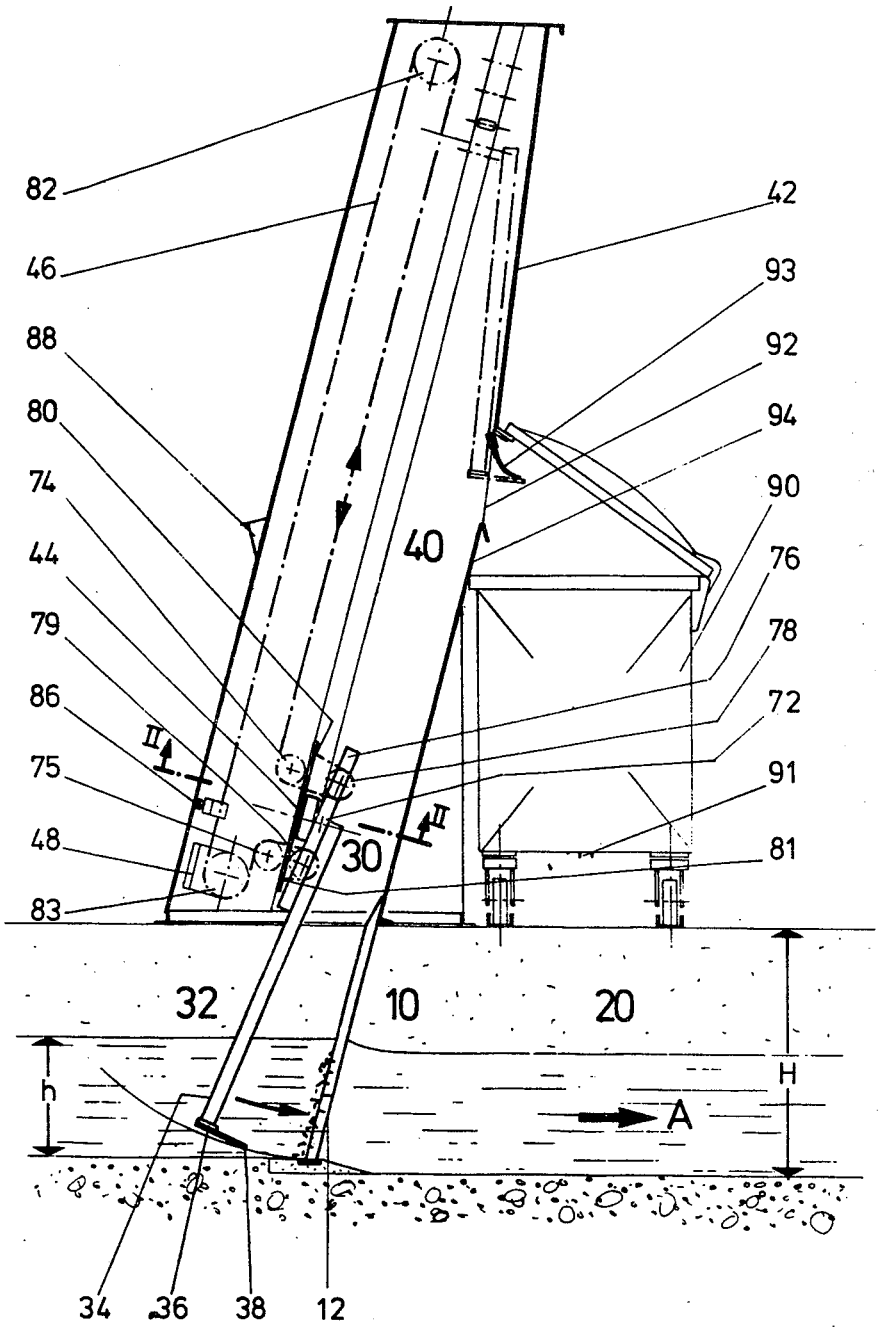

The invention refers to trashrack installations for liquid-borne trash having a rack cleaner mechanism which cleans the rack rods and which includes a comb with teeth, which, via a tilting mechanism, is connected to be able to pivot between a cleaning position and a free position, to a carrier which can be moved by means of a conveyor mechanism along a guiding device, the tilting mechanism and the carrier being coupled together on the one hand via an applicator mechanism actuable by means of the conveyor mechanism and on the other hand via a release mechanism.

A trashrack installation of the kind described above is known, for example, from U.S. Pat. No. 2,524,304. This trashrack installation exhibits as a carrier for the comb carriage which is guided freely along the rack rods and is arranged freely suspended by means of a tension cable from a conveyor mechanism. The return motion follows under the influence of gravity, by release of the tension cable and the cleaning motion by hauling in the tension cable. This is guided on the supporting carriage round a guide pulley which is connected to a friction coupling on which is arranged, via an eccentric, a lever mechanism for actuation of the tilting mechanism for the comb. The latter consists of a shaft bearing guidewheels and also the teeth of the comb. The lever mechanism pivots the teeth of the comb into the cleaning position and into the free position. The pivotal movement is limited by stops.

What is disadvantageous in the case of this known trashrack installation is that the supporting carriage runs along the rackrods and hence during the return motion has to run over the trash accumulated on the rackrods. This results in the supporting carriage running on the trash and becoming lifted from the rack rods. In the case of large pieces of trash it may happen that the supporting carriage remains suspended on them and cannot be let right back. This is made worse by the fact that the return motion occurs exclusively under the influence of gravity and no active drive is present or possible.

Since the teeth of the comb are arranged on the shaft of the guidewheels their length is limited. The consequence of this is that upon the supporting carriage running over the accumulated trash the teeth of the comb cannot penetrate the trash completely, whereby removal of the trash becomes more difficult or is even completely prevented. Through the immersion of the supporting carriage in the liquid to be cleaned, which as a rule is water, the supporting carriage is not only covered with filth and is damaged, but also suffers considerable corrosion. In low temperatures in winter there is added the danger that the movable parts of the supporting may ice up and lock, whereby the whole installation becomes unusable. Since for the return motion the force of gravity fron the supporting carriage is necessary, this can be used practically only on vertical rack rods.

According to the present invention a trashrack installation comprises trash collecting rack rods and a rack cleaner mechanism for cleaning the rack rods and which includes a toothed comb mounted on a tilting mechanism, and pivotable between a cleaning position and a free position, on a carrier which can be removed by means of a conveyor mechanism along a guiding device, tilting of the tilting mechanism relative to the carrier being actuated by movements of the conveyor mechanism, the guiding device being arranged remote from the rack rods through which the liquid flows and the carrier including a brake mechanism the braking force of which is sufficient to prevent movement of the carrier under gravity, but which is insufficient to prevent the conveyor mechanism moving the carrier either in a direction for cleaning or on its return.

Such an installation has a simple construction and enables good cleaning and a high degree of operating reliability.

The fact that the guide mechanism for the carrier is arranged outside the closed region of the rack rods and at a clearance from these prevents the carrier from having to run over the trash accumulated on the rack rods and from dipping in the flowing liquid. It is thereby ensured that the carrier is always guided accurately and hence the comb both during the return motion and during the cleaning motion can run satisfactorily. Since the carrier does not come into contact with the liquid, it and its drive cannot be soiled and damaged by trash, the danger of corrosion is reduced to a minimum and the operating reliability is guaranteed even at low temperatures, since no liquid can ice up the movable parts of the carrier and hence lock it.

Operation of the carrier and the comb is further improved because the carrier exhibits a brake mechanism which excludes actuation of the carrier under gravity, so that the conveyor mechanism is necessary for driving it both in the return motion and in the cleaning motion. The motion of the carrier is thereby not left to chance but is positively controlled. The result therefrom is not only good cleaning of the rack rods but also considerable improvement in the operating reliability of the trashrack installation. The rack rods may be arranged both sloping and also horizontal.

Preferably the end of a tension member of the conveyor mechanism passes round a guide pulley supported on the carrier, the tension member being connected at its end directly either to the tilting mechanism to the carrier to enable tilting to occur in a first direction under the action of the movement of the conveying mechanism. In the latter case the end of the tension member is connected to the carrier and passes around a second pulley mounted on the tilting mechanism. In particular in the latter case with relatively small tension a relatively large force of application of the comb against the rack can be achieved, since the double return of the tension member acts as a pulley block. In this case the force of application is directly dependant upon the tension in the tension member of the conveyor mechanism. If, for example, there is lying against the rack a rather heavy deposit which requires a rather hard pull, this harder pull at the same time brings about a stronger application of the comb against the rack rods, whereby secure taking of the trash along with it is achieved. In particular with the employment of a guide pulley on the carrier this force of application is further increased.

The release mechanism can be made of various forms, for example, it may include a spring arranged between the carrier and the tilting mechanism, the spring force of which opposes the force of application but is smaller than this. A particularly advantageous and simple design of the release mechanism results when the return strand of a tension member of the conveyor mechanism is led round a guide pulley supported on the carrier, in which case the return strand may be connected directly to the tilting mechanism or preferably led via a guide pulley supported rotatably on the tilting mechanism back to the carrier and connected to it. In this case the force of release here is also dependant upon the backhaul force of the tension member. If, for example, there is an obstruction in the return path which makes a higher backhaul force necessary the release force is increased too, so that the comb can come free in a simple manner from the obstruction in the return path.

The brake mechanism may where necessary be so formed that it includes brakeshoes which act on the running rollers of a carrier formed as a trolley. A particularly simple form of the brake mechanism results if the brakeshoes are prestressed by means of a spring against the friction surface. These friction surfaces may also be rails of the guiding device for the carrier.

In the case of particularly long trashrack installations, where necessary a number of driven carriers may be provided, on which in each case the comb may be arranged via a separate tilting mechanism.

For particularly simple setting of the comb against the rack rods, in particular with respect to the bottom of a channel in which the rack rods are arranged, the comb may be arranged to be adjustable longitudinally to the tilting mechanism.

Preferably, the trashrack installation includes a discharge point for the material taken off the rack rods by means of the comb, at the upper edge of which is arranged a stripper member which upon the return motion at least partially sweeps the teeth of the comb. Such a stripper member may, for example, be a comb or flexible plate.

The trashrack installation may be surrounded by a housing which includes the discharge opening. A housing like this can protect the driven parts against dirt, wet and cold.

Figure 2:
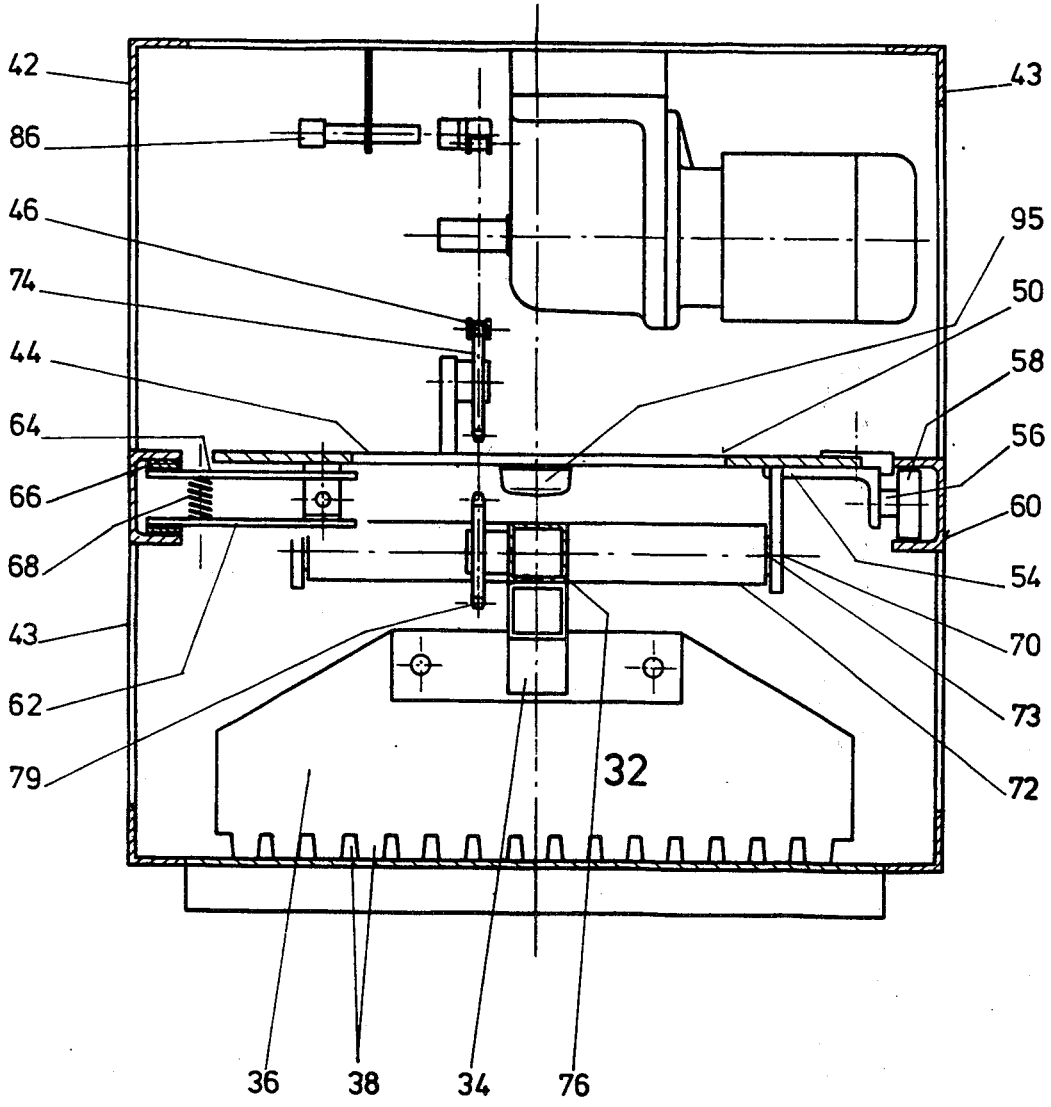

One example of a trashrack installation in accordance with the invention will now be described with the aid of the accompanying drawings, in which:

FIG. 1 shows a trashrack installation with rack cleaning mechanism in vertical section; and, FIG. 2 shows the trashrack installation in section through the carrier with tilting mechanism along the line II—II in FIG. 1.

In the trashrack installation illustrated a rack 10 is built into a channel 20 and equipped with a rack cleaning mechanism 30.

The rack has rack rods 12 which are parallel with one another and with the sidewalls of the channel 20 and arranged, in the usual way, oblique to the flow A. The rack cleaning mechanism 30 includes a comb 32 with a holder 34 on which a foot 36 is arranged, having teeth 38 which can be pulled up between the rods 12 of the rack 10. The comb 32 is lifted, by means of a hoist mechanism 40 which is accomodated in a housing 42, through the overall height H of the channel and to a discharge position.

The hoist mechanism has a carrier 44 formed as a trolley to which the comb 32 is connected to be able to move up and down; to this supporting carriage 44 are fastened the two ends of a hoist chain 46 of a conveyor mechanism which includes a geared motor 48 for driving it.

The supporting carriage 44 has a bridge 50 to which are fastened on both sides angle irons 54 (in FIG. 2 only one angle iron is shown). On these are arranged stub axles 56 for guide rollers 58 which run in the rails 60, U-shaped in cross-section, of a guiding device which is connected to opposite walls 43 of the housing. The guiding device lies above the rack rods 12 and at a clearance from them.

In addition the supporting carriage 44 is equipped with a brake mechanism 62. This consists of two brakeshoes 64 parallel with the bridge 50, which project between the rail 60 and which on their portions directed towards the rail, are provided with brake linings 66. A spring 68 is arranged between the brakeshoes 64 in order to press them against the inside of the rail 60. The spring 68 is so dimensioned that the supporting carriage 44 even in its downwards motion of the return motion must be pulled i.e., the supporting carriage is self-locking on the rails 60.

The supporting carriage 44 has two projections 70 directed perpendicular to the bridge 50 in which a tilting mechanism 72 for the rake 32 is supported by pins 73, the axis of these running horizontally and transverse to the direction of flow A.

Finally, guide sprockets 74, 75 for the hoist chain 46 are fitted to the bridge 50, the axes of the guide sprockets lying parallel with the axes of the pins 73.

The tilting mechanism 72 is used for pivotal attachment of the comb 32 to the supporting carriage 44 and is provided with a bracket 76 to which the holder 34 of the comb 32 is fastened, that is, so that the comb 32 is adjustable both in height and also along the axis of the pins 73. The tilting mechanism 72 in addition enhibits two further guide sprockets 78, 79 for the hoist chain 46, which are supported rotatably from the bracket 76.

Hence, the hoist chain 46 runs from an upper point of attachment 80 to the bridge 50, round the upper guide sprocket 78 on the tilting mechanism 72, round the upper guide sprocket 74 on the bridge 50, thence upwards over an upper guide sprocket 82 in the housing 42, then downwards to a lower driving sprocket 83 in the housing 42 and round the bottom guide sprockets 75, 79 on the supporting carriage 44 and the tilting mechanism respectively and to a lower point of attachment 81 on the bridge 50 of the supporting carriage 44.

On the hoist chain are parts of two switch mechanisms in the form of magnets (N + S) which act upon a stationary reversing switch 86 for the chain drive. A main on/off switch is also provided.

The wide face of the housing 42 on the downstream side has a discharge opening 92 through which the rubbish cleared from the rack 10 by the comb 32 drops into a portable rubbish-bin 90 which stands next the housing. Advantageously this rubbish bin 90 includes openings 91 in the bottom of it for water to run out. The upper edge of the discharge opening 92 is formed by a stripper member 93 of flexible material, which can be displaced by the comb 32 from a rest position in which it hangs down freely into a stripping position (FIG. 1). Between the lower boundary of the discharge opening and the top end of the rack rods a slideplate 94 is arranged, the slope of which is equal to that of the rack rods 12.

With the device described the following materials in particular are used. The rack rods consist of noncorroding metal and the comb foot consists of plastics. This guarantees quiet operation. Moreover the comb foot is replaceable since it is amongst the most severely stressed parts of the device. The stripper member advantageously consists of rubber or a rubberlike plastics. The housing is constructed of "Eternit" sheeting. The other components consist essentially of ordinary structural steel and are advantageously hot galvanized.

The method of operation of the trashrack installation described and its rack cleaning mechanism is as follows:

The water flowing in the channel 20 in the direction of the arrow A may contain trash such as paper, driftwood, night soil or the like, which get caught by the rack rods 12 of the rack 10. By means of the comb 32 this trash gets removed from the rack and conveyed to the rubbish bin.

FIG. 1 shows the rake and the carriage in their bottom position of reversal. The lower driving sprocket 83 in the housing is first driven by the geared motor 48 anticlockwise. The hoist chain 46 is thereby set in motion and on the upstream side runs downwards and on the downstream side runs upwards over the driven driving-sprocket 83 and around the guide sprocket 82 which runs freely with it. Thereupon the supporting carriage 44 is, in a cleaning motion, moved upwards in the rails 60, overcoming the self-locking action of the brake mechanism 62. With the pulling upwards of the supporting carriage the tilting mechanism 72 is pivoted anticlockwise by the action of the hoist chain running upwards round the upper guide sprocket 78 until the teeth on the comb foot engage between the rack rods or lie against the trash. The guide sprockets 74 and 78 over which the conveyor member runs, act therefore as the applicator mechanism for the comb. In this position the comb slides upwards and thereby clears the rack.

Occasionally extraordinarily bulky or heavy trash floats against the rack rods. In such cases no sticking of the comb results during the return motion. Because on the striking of the comb foot against trash of this kind the backhaul force gets stronger and the hoist chain is slackened at the upper guide sprockets 46 and 78. The intensified backhaul force also intensifies the releasing force of the tilting mechanism and this pivots clockwise, whereby the comb comes free and can slide past over the obstruction.

When the teeth on the comb foot have reached the top end of the rack rods they slide on upwards against the slideplate 94 until the comb foot reaches the discharge opening 92 in the housing. During the raising of the comb foot up to the upper end of this discharge opening, which may be provided with a stop, the comb 32 at the same time swings out to the right and empties the rubbish cleared from the rack into the rubbish bin. Between the supporting carriage and the tilting mechanism there are stops which limit the discharge motion of the comb. Through the violent meeting of the stops as the teeth suddenly come free at the discharge opening, the emptying of the trash from the comb is facilitated.

When the comb has reached the position shown in broken line in FIG. 1 it is lying in its upper position of reversal, the supporting carriage likewise has reached its upper position of reversal, whilst the magnet N has reached its lower position. The geared motor is thereby switched over and the driving sprocket 83 starts to rotate clockwise. Thereupon the upstream strand of the hoist chain runs upwards, the downstream side runs downwards and the supporting carriage gets hauled back down, the tilting mechanism 72 being pivoted clockwise under the action of the hoist chain on the lower guide sprocket 79, so that the comb 32 comes free of the rack rods. A spring 100 can be provided between the carrier and tilting mechanism to bias the tooth comb towards the inoperative position in place of or in addition to the action of the hoist chain. During the backwards pivoting of the comb it gets freed of possible residual trash by the flexible plate acting as stripper. The comb foot is thus raised from the surface and arrives at its lower position without touching the rack rods, the guide sprockets 75, 79 in combination with the hoist chain 46 acting as release mechanism for the comb.

A trashrack installation together with rack cleaning mechanism for the kind described is particularly suitable for smaller installations with channels for throughflow amounts up to 150 liters per second or $9m^3$ per minute. For manufacture and storage it is essential for the trashrack installation to be able to satify very different requirements. By the exchange or other arrangement of a few components the trashrack installation can be adapted to other conditions in each case. In particular the depth of the channel may vary within certain limits without the trashrack installation having to be altered other than by resetting the comb on the tilting mechanism. Moreover the installation is adaptable to different widths of channel, though for channels of great width a number of supporting carriages must be provided. In this case a horizontal rail which connects the comb to the supporting carriage is advantageous. Again, rack rods of different widths and clearances may be employed, so that in each case merely an appropriate comb foot has to be fitted.

Different elements of the trashrack installations with a rack cleaning mechanism as described above may also be executed otherwise than as described above.

The conveyor mechanism may, for example, exhibit instead of the hoist chain a hoist rope or be equipped with a draw spindle.

Furthermore the applicator mechanism and the release mechanism may be formed as lever mechanisms supported pivotally on the supporting carriage, which are connected at the one end to the conveyor mechanism and at the other end to the tilting mechanism. The release mechanism may be formed as a spring, such as spring 100, arranged between the supporting carriage and the tilting mechanism, the spring force from which opposes the force of application but is smaller than it.

The brake mechanism may also be so formed that it acts on the rollers of the carriage.

I claim:

1. A trashrack installation for liquid-borne trash, said installation having trash collecting rack rods and a rack cleaner mechanism for cleaning said rack rods, said cleaning mechanism including a tilting mechanism and a toothcomb mounted on said tilting mechanism, said installation further having a carrier for said toothcomb, a guiding device, a drive unit and a conveyor mechanism, said tilting mechanism being mounted on said carrier to allow for tilting said toothcomb between a cleaning position and an inoperative position, said drive unit and conveyor mechanism being operatively connected with each other and with said carrier to move said carrier along said guiding device in a lifting or lowering direction, said conveyor mechanism including two tension member sections connected with said tilting mechanism and with said drive unit, a first of said sections being in a positive lifting drive connection with said carrier and the second of said sections being in a positive lowering drive connection with said carrier and having a portion arranged to draw the carrier downwards and also being operatively connected with said tilting mechanism to move said toothcomb towards said inoperative position in conjunction with a lowering operation, said first tension member section also being operatively connected with said tilting mechanism to move said toothcomb towards said cleaning position in conjunction with a lifting operation, said carrier including a brake mechanism acting in opposition to both a lifting and lowering movement of the carrier along said guiding device, said brake mechanism providing a braking force sufficient to prevent movement of said carrier under gravity but insufficient to prevent said conveyor mechanism and drive unit moving the carrier in the lifting or lowering operation.

2. A trashrack installation according to claim 1, in which a first guide pulley is arranged on said carrier, said first tension member section passing round said first guide pulley and being connected to said tilting mechanism for tilting said toothcomb towards said cleaning position on movement of said carrier in the lifting direction.

3. A trashrack installation according to claim 1, in which a first guide pulley is arranged on said carrier and a second guide pulley is arranged in said tilting mechanism, said first tension member section passing round both of said first and second guide pulleys and being connected to said tilting mechanism for tilting said toothcomb towards said cleaning position on movement of said carrier in the lifting direction.

4. A trashrack installation according to claim 1, in which a spring is arranged between said carrier and said tilting mechanism to bias said toothcomb towards said inoperative position.

5. A trashrack installation according to claim 1, in which a first guide pulley is arranged on said carrier, said second tension member section passing round said first guide pulley and being connected to said tilting mechanism for tilting said toothcomb towards said inoperative position on movement of said carrier in the lowering direction.

6. A trashrack installation according to claim 1, in which a first guide pulley is arranged on said carrier and a second guide pulley is arranged in said tilting mechanism, said second tension member section passing round both of said first and second guide pulleys and being connected to said tilting mechanism for tilting said toothcomb towards said inoperative position on movement of said carrier in the lowering direction.

7. A trashrack installation according to claim 1, in which said guiding device of the toothcomb carrier is disposed remote from said rack rods through which said liquid flows.

8. A trashrack installation according to claim 1, wherein said tilting mechanism includes a balance beam having arms on both sides of its pivot, said first and second tension member sections each being connected to one of said arms.

9. A trashrack installation according to claim 1, wherein said first and second tension member sections are the ends of a tension member which is in operative connection with said drive unit.

10. A trashrack installation according to claim 1, wherein said brake mechanism includes at least two brake shoes and wherein said guiding device includes a friction surface, said brake shoes being biased into engagement with said friction surface.

11. A trashrack installation according to claim 10, wherein said guiding device includes at least one rail defining said friction surface.

12. A trashrack installation according to claim 1, further including an additional, similarly constructed and driven carrier, a further comb mounted on said carrier by means of a further tilting mechanism.

13. A trashrack installation according to claim 1, wherein said comb is adjustably mounted on said tilting mechanism.

14. A trashrack installation according to claim 1, which further defines a discharge point, said discharge point having an upper edge and said upper edge including a stripper member which, upon the return motion of said comb at least partially sweeps the teeth of said comb.

15. A trashrack installation according to claim 1, further including a housing, said housing containing said discharge opening.

16. A trashrack installation for liquid-borne trash, comprising trash collecting rack rods and a rack cleaner mechanism for cleaning said rack rods, said cleaning mechanism including a tilting mechanism and a toothcomb mounted on said tilting mechanism, a carrier for said toothcomb, said tilting mechanism being mounted on said carrier for tilting said toothcomb between a cleaning position and an inoperative position, conveyor means for moving said carrier in a lifting or lowering direction, said conveyor means including a frame, a continuously operated brake acting between said frame and said carrier to prevent movement of said carrier under gravity, a first tension member section connected to said tilting mechanism for above said carrier, a second tension member section connected to said tilting mechanism from below said carrier, and a drive unit coupled to said first tension member section for lifting said carrier against the opposition of said brake and moving said toothcomb towards said cleaning position and coupled to said second tension member section for lowering said carrier against the opposition of said brake and moving said toothcomb towards said inoperative position.

17. A trashrack installation according to claim 16 including a first guide mounted above said carrier and a second guide mounted below said carrier, said first tension member section being connected to said tilting mechanism from said first guide above said carrier and said second tension member section being connected to said tilting mechanism from said second guide below said carrier.

* * * * *